United States Patent [19]

Romine et al.

[11] Patent Number: 5,032,250

[45] Date of Patent: Jul. 16, 1991

[54] PROCESS FOR ISOLATING MESOPHASE PITCH

[75] Inventors: Hugh E. Romine; James R. McConaghy, Jr., both of Ponca City, Okla.

[73] Assignee: Conoco Inc., Ponca City, Okla.

[21] Appl. No.: 288,585

[22] Filed: Dec. 22, 1988

[51] Int. Cl.[5] ..... C10G 27/00; C10C 3/04

[52] U.S. Cl. ..... 208/39; 208/44; 208/45; 208/39; 208/22

[58] Field of Search ..... 208/45, 44, 39, 22

[56] References Cited

U.S. PATENT DOCUMENTS

| | | | |
|---|---|---|---|
| 3,558,468 | 1/1971 | Wise | 208/45 |
| 3,595,946 | 7/1971 | Joo et al. | 264/29 |
| 3,974,264 | 8/1976 | McHenry | 423/447.4 |
| 3,976,729 | 8/1976 | Lewis et al. | 264/29.7 |
| 4,017,327 | 4/1977 | Lewis et al. | 423/447 |
| 4,026,788 | 5/1977 | McHenry | 208/39 |
| 4,066,737 | 1/1978 | Romovacek | 423/447.6 |
| 4,184,942 | 1/1980 | Angier et al. | 208/45 |
| 4,208,267 | 6/1980 | Diefendorf et al. | 208/22 |
| 4,209,500 | 6/1980 | Chwastiak | 208/44 |
| 4,277,324 | 7/1981 | Greenwood | 208/45 |
| 4,283,269 | 8/1981 | Greenwood | 208/45 |
| 4,341,621 | 7/1982 | Fitzgerald | 208/45 |
| 4,381,990 | 5/1983 | Noguchi | 208/45 |
| 4,402,928 | 9/1983 | Lewis et al. | 208/45 |
| 4,464,240 | 8/1984 | Dickakian | 208/44 |
| 4,465,586 | 8/1984 | Diefendorf et al. | 208/39 |
| 4,474,617 | 10/1984 | Uemura et al. | 208/22 |
| 4,502,943 | 3/1985 | Dickakian | 208/39 |
| 4,575,412 | 3/1986 | Yudate et al. | 208/45 |
| 4,578,177 | 3/1986 | Yudate et al. | 208/45 |
| 4,581,124 | 4/1986 | Gomi et al. | 208/39 |
| 4,620,919 | 9/1986 | Uemura et al. | 208/39 |
| 4,756,818 | 7/1988 | Peter et al. | 208/45 |

FOREIGN PATENT DOCUMENTS

| | | | |
|---|---|---|---|
| 60-65090 | 4/1985 | Japan | 208/45 |
| 170694 | 4/1985 | Japan | 208/45 |
| 1072096 | 4/1986 | Japan | 208/45 |

*Primary Examiner*—Helane Myers

[57] ABSTRACT

Isotropic pitch containing mesogens is combined with a solvent and subjected to dense phase or supercritical conditions and the mesogens are phase separated. In one aspect the isotropic pitch containing mesogens is fluxed with a solvent to solubilize the mesogens, the flux mixture is filtered to remove nonsolubles and the mesogens are phase separated by use of the same solvent under dense phase or supercritical conditions of temperature and pressure. The phase separation conditions are such that the mesogens are recovered as mesophase.

23 Claims, 1 Drawing Sheet

PROCESS FOR ISOLATING MESOPHASE PITCH

BACKGROUND AND SUMMARY OF THE INVENTION

It is well known that carbon fibers having excellent properties suitable for commercial use can be produced from mesophase pitch. Mesophase pitch derived carbon fibers are light weight, strong, stiff, thermally and electrically conductive, and both chemically and thermally inert. The mesophase-derived carbon fibers perform well as reinforcements in composites, and have found use in aerospace applications and quality sporting equipment.

Low cost carbon fibers produced from isotropic pitch exhibit little molecular orientation and relatively poor mechanical properties. In contrast, carbon fibers produced from mesophase pitch exhibit highly preferred molecular orientation and relatively excellent mechanical properties.

The term "pitch" as used herein means petroleum pitches, natural asphalt and heavy oil obtained as a by-product in the naphtha cracking industry, pitches of high carbon content obtained from petroleum asphalt and other substances having properties of pitches produced as by-products in various industrial production processes.

The term "petroleum pitch" refers to the residuum carbonaceous material obtained from the thermal and catalytic cracking of petroleum distillates or residues.

The term "anisotropic pitch" or "mesophase pitch" means pitch comprising molecules having aromatic structure which through interaction have associated together to form optically ordered liquid crystals.

The term "isotropic pitch" means pitch comprising molecules which are not aligned in optically ordered liquid crystals.

The term "mesogens" means mesophase-forming materials or mesophase precursors.

Mesophase pitch is not ordinarily available in existing hydrocarbon fractions, such as refining fractions, or in coal fractions, such as coal tars. Mesophase pitch, however, may be derived from isotropic pitch containing mesogens. Isotropic pitch containing mesogens is usually prepared by the treatment of aromatic feedstocks. Such treatment, which is well known in the art, may involve one or more heat soaking steps, with or without agitation, and with or without gas sparging or purging. Gas sparging may be carried out with an inert gas or with an oxidative gas, or with both types of operations. Numerous patents describe various aspects of the treatment of aromatic containing feedstocks to obtain isotropic pitch. Included are: U.S. Pat. Nos. 4,209,500, heat soaking; 3,976,729 and 4,017,327, agitation during heat treatment; 3,974,264 and 4,026,788, inert sparge gas during heat treatment; 4,283,269, heat soaking of fluxed pitch; Japanese Patent No. 65090/85, heating in the presence of an oxidizing gas; U.S. Pat. Nos. 4,464,248, catalytic heat soaking; 3,595,946 and 4,066,737, use of oxidative reactive material; and 4,474,617, use of oxidizing gas; and many others.

Mesophase pitch may be obtained from isotropic pitch containing mesogens by solvent fractionation, which is carried out by the following steps:

(1) Fluxing the isotropic pitch in a hot solvent.

(2) Separating flux insolubles by filtration, centrifugation, or other suitable means.

(3) Diluting the flux filtrate with an anti-solvent (comix solvent) to precipitate a mesophase-forming (mesogen containing) pitch.

(4) Washing and drying the precipitated pitch.

(5) Fusing the precipitated pitch to form mesophase.

The solvent fractionation procedure described is well known in the art and is set forth in some detail in numerous patents, including U.S. Pat. No. 4,277,324, which is incorporated herein by reference. This patent sets forth numerous solvent and anti-solvents which can be employed in solvent fractionation and the operating conditions and procedures which may be used.

Separation of mesogens from isotropic pitch may also be effected by the solvent extraction process described in U.S. Pat. No. 4,208,267. In this patent fractionation is accomplished without fluxing or flux filtration. The mesogen-containing isotropic pitch is extracted with a comix type solvent and the mesogens are collected as an insoluble residue. Solvents used in this process are similar to those employed in the process of U.S. Pat. No. 4,277,324.

It is desirable to provide an alternative process for obtaining mesophase pitch from isotropic pitch which does not involve the use of a comix solvent, and thus eliminates the need for storage and pumping facilities for two solvents and separation facilities for separating the solvents.

According to the present invention, isotropic pitch containing mesogens is combined with a solvent and subjected to dense phase or supercritical conditions to effect phase separation of the mesogens from the pitch. In one aspect of the invention, isotropic pitch containing mesogens is fluxed with a solvent to solubilize the mesogens, the flux mixture is then filtered to remove insolubles, and the solubilized mesogens are phase separated from the flux mixture under dense phase or supercritical conditions of temperature and pressure. The dense phase or supercritical conditions employed are such that the mesogens are recovered as mesophase.

THE PRIOR ART

U.S. Pat. No. 4,581,124 discloses treatment of a pitch (containing a substantial amount of mesophase, i.e. 5 to 25 weight percent) with solvent extraction under supercritical conditions to recover a mesophase rich pitch containing at least 30 percent mesophase and preferably at least 50 percent mesophase by weight.

Japanese Patent No. 60-170694 discloses the preparation of precursor pitch for carbon fibers by extracting coal tar pitch with an aromatic solvent in a critical state. The extracted pitch is then subjected to heat treatment with sparging of inert gas to give the desired product.

U.S. Pat. No. 4,277,324 discloses converting an isotropic pitch to anisotropic (mesophase) pitch by solvent fractionation. Isotropic pitch is first mixed with an organic fluxing solvent. Suspended insoluble solids in the flux mixture are then removed by physical means, such as filtration. The solids-free flux liquid is then treated with an antisolvent to precipitate a mesophase-forming pitch which is fused to form mesophase. The patent further discloses heat soaking the pitch prior to solvent fractionation.

U.S. Pat. No. 4,208,267 discloses extracting isotropic pitches with a comix (antisolvent) solvent to provide a solvent insoluble fraction. This fraction when heated to 230° C. to 400° C. is converted to greater than 75% mesophase.

DETAILED DESCRIPTION OF THE INVENTION

Figure 1:
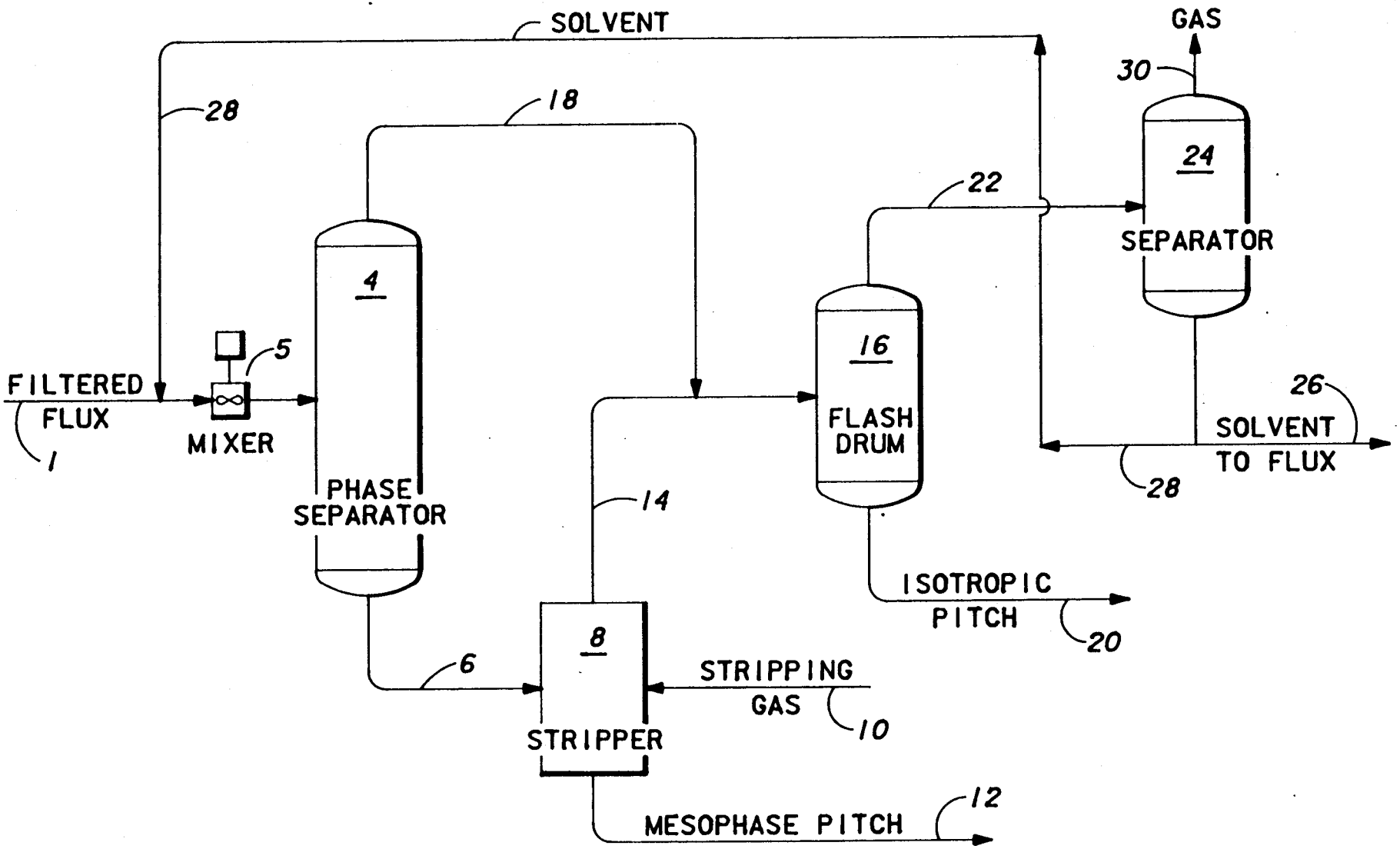
FIG. 1 is a schematic diagram of a process unit suitable for producing mesophase pitch which illustrates the invention.

Suitable isotropic pitches for use in carrying out the process of the invention are obtained by various treatments of heavy aromatic fractions, including heat soaking. While heavy fractions generally may be used, the preferred materials are petroleum pitches as previously defined. On a weight basis, particularly useful pitches will contain from about 88 percent to about 93 percent carbon, and from about 9 percent to about 4 percent hydrogen. While elements other than carbon and hydrogen such as sulfur and nitrogen are normally present in such pitches, it is important that these other elements do not exceed about 5 percent by weight of the pitch. Also, these particularly useful pitches typically will have an average molecular weight on the order of about 200 to about 1000.

Useful starting materials in addition to the preferred petroleum pitches include ethylene cracker tars, coal derivatives, petroleum thermal tars, and aromatic distillates having a boiling range of from 650° to 950° F.

When heat soaking is employed to obtain suitable isotropic pitch, this procedure is usually accomplished at a temperature in the range of about 370° to about 500° C. for about 0.10 to about 240 hours. Lower soak temperatures require longer soak times and vice versa. The preferred soaking conditions are from about 2 to about 24 hours at a temperature range of about 390° to about 430° C. As mentioned previously, the heat soaking step may be carried out with or without agitation and with or without the presence of a sparge or purge gas.

In the preferred aspect of the invention, isotropic pitch containing mesogens is mixed with a fluxing solvent and is fluxed to solubilize the mosogens.

A variety of solvents are suitable for use as the fluxing material. They include such compounds as aromatics such as benzene and naphthalene, napthenoaromatics such as tetralin and 9,10-dihydroanthracene, alkyl aromatics such as toluene, xylenes and methyl naphthalenes, hetero-aromatics such as pyridine, quinoline and tetrahydrofuran; and combinations thereof. Also suitable are simple halo carbons, including chloro and fluoro derivatives of paraffin hydrocarbons containing 1 to 4 carbon atoms such as chloroform and trichloroethane and halogenated aromatics such as trichlorobenzene. In general, any organic solvent having a critical temperature below about 500° C., which is non-reactive with the pitch and which, when mixed with the pitch in sufficient amounts, is capable of solubilizing the mesogens may be used in carrying out the process of the invention. At temperatures above about 500° C. undesirable reactions can take place with or between aromatic compounds in the pitch.

The amount of fluxing solvent used will vary depending upon the temperature at which mixing is conducted and the composition of the pitch. In general, the amount of solvent used will be in the range of between about 0.05 parts by weight of solvent per part by weight of pitch to about 2.5 parts by weight of solvent per part by weight of pitch. Preferably, the weight ratio of flux solvent to pitch will be in the range of from about 0.7 to 1 to about 1.5 to 1. The fluxing operation is usually carried out at an elevated temperature and at sufficient pressure to maintain the system in the liquid state. Mixing or agitation are provided during the fluxing operation to aid in the solubilization of the mesogens. Usually the fluxing operation is performed at a temperature in the range of between about 30° and about 150° C. and for a time period between about 0.1 and about 2.0 hours. However, fluxing may be carried out up to the boiling point of the solvent at system pressure. If desired, the flux mixture may be stored in tankage indefinitely.

Upon completion of the fluxing step, the solubilized mesogens are separated from the insoluble portion of the pitch by the usually techniques of sedimentation, centrifugation or filtration. If filtration is the selected separation technique used, a filter aid may be employed, if desired, to facilitate the separation of the fluid material from the solids.

The solid materials which are removed from the fluid pitch consist of materials such as coke and catalyst fines which were present in the pitch prior to heat soaking, as well as those insolubles generated during heat soaking. If heat soaking conditions are not carefully controlled, mesophase may be generated in the pitch during heat soaking. This mesophase is partially lost in the process since it is predominantly insoluble in the flux mixture and is removed with the other insolubles during the separation process. In the process of the invention, isotropic pitch, which is substantially free of mesophase, is preferred since this means that the prior treatment of the pitch has been accomplished in a manner to provide for a maximum amount of mesogens in the pitch prior to solvent fractionation.

After removal of the solids from the system, the remaining pitch solvent mixture containing dissolved mesogens is subjected to supercritical temperature and pressure, i.e. temperature and pressure at or above the critical temperature and critical pressure of the flux solvent to effect phase separation of the mesogens from the pitch. In the case of toluene, for example, the critical conditions are 319° C. and 611 psia. The time required to separate mesogens from the system will vary, depending on the particular pitch and the solvent employed and the geometry of the separation vessel. If desired, additional fluxing solvent may be added to the system. The amount of such added solvent may be up to about 12 parts of solvent by weight per part by weight of pitch and preferably from about 0.5 to about 6 parts of solvent per part of pitch. If additional fluxing solvent is added, agitation or mixing is desirable to promote intimate interphase contact.

In the prior art method of solvent fractionation of isotropic pitch, which included the use of a comix or anti-solvent, a fusing operation served to convert the mesogens to mesophase pitch. In the process of this invention, fusing is not necessary to accomplish this conversion since the product obtained from the supercritical phase separation step is mesophase rather than mesogens.

The supercritical conditions applied in carrying out the process of the invention will vary depending on the solvent used, the composition of the pitch and the temperature employed. The level of supercritical pressure may be used to control the solubility of the pitch in the solvent and thus established the yield and the melting point of the mesophase product. For example, at a given temperature and solvent-to-pitch ratio, if the pressure on the system is increased, the solubility of the pitch in the solvent also increases. This results in a lower yield of higher melting point mesophase product. Lowering the pressure gives the opposite result. Generally the supercritical temperature employed will be at or somewhat above the critical temperature of the solvent, e.g. from 0° to about 100° C. above the solvent critical temperature. If desired, higher temperatures may be used; however, they are not required. The pressure maintained on the system will vary over a wider range since it is most conveniently used for controlling product properties and yield. Thus the pressure applied on the system may be up to twice as high as the critical pressure or higher if desired.

The temperature and pressure required for the process herein are the same as or higher than the critical temperature and pressure of the solvent used in the process. Suitable solvents are those solvents which have critical temperatures in the range of from about 100° C. to about 500° C. The upper temperature limit is controlled by the thermal stability of the pitch and/or solvent mixture. The lower temperature limit is set by the critical temperature of the particular solvent used. Preferred solvents have critical temperatures above 200° C.; however, other solvents such as the halocarbons have lower critical temperatures. For example chlorotrifluoromethane has a critical temperature of 29° C. The process temperature is typically up to about 100° C. above the critical temperature of the solvent or higher.

The process pressure is generally from about 300 psig to about 5,000 psig, preferably from about 500 psig to about 3,000 psig. It should be noted however, that some pitch/solvent process systems may utilize higher or lower pressures. The system pressure varies over a wide range since it is most conveniently used for controlling product properties and yield. Thus, the pressure applied to the system may be up to twice as high as the critical pressure of the solvent or higher.

The amount of solvent used in the process and the temperature employed also affect the solubility of the pitch in the solvent which in turn affects the melting point of the mesophase product. For example, increasing the amount of solvent increases the amount of pitch solubilized and a similar effect is obtained with increasing temperature. Both of these variations result in a reduced yield of mesophase product of increased melting point.

Upon completion of phase separation of the mesogens (now mesophase) from the pitch, flux solvent dissolved in the mesophase may be removed by reducing the system pressure while maintaining the temperature at a sufficient level to maintain the mesophase in the liquid state. Solvent removal is usually carried out at a temperature of between about 300° and about 400° C. for between about 0.01 and about 2 hours, depending on the type of solvent removal procedure used. For example, with thin film evaporation only very short residence times are required.

The mesophase pitch product obtained in the process of the invention can be spun into continuous and isotropic carbon fibers by conventional procedures, such as melt spinning, followed by the separate steps of stabilization and carbonization. These are known techniques and consequently they do not constitute a critical feature of the present invention.

In addition to the conventional solvent fluxing, the process of this invention also includes enhanced fluxing. Enhanced fluxing employs elevated temperatures and pressures up to the critical conditions for the flux mixture. Enhanced fluxing offers higher solubility leading to improved yields. It also offers process advantages such as greater compatibility with the supercritical conditions employed in the process and easier flux filtering of less viscous mixtures. The solvent ratio employed with enhanced fluxing will vary from between about 0.5 and about 2.5 parts by weight of solvent per part of weight by pitch.

After removal of the solvent the liquid mesophase recovered under the supercritical conditions of the invention may be spun directly, or alternatively this material may be cooled to a solid phase material for transport in storage. If desired, the mesophase product may be solvent washed and dried as in the conventional two solvent process.

In the preferred aspect of the invention, as aforedescribed, solvent fluxing of the heat soaked isotropic pitch and filtration of the flux mixture removes inorganic contaminants and flux insoluble components from the desired product. This results in a high quality mesophase having a very low quinoline insolubles content. Dense phase or supercritical separation of the mesogens from the pitch may also be effected without the fluxing or filtration steps to provide a desirable mesophase product. While the mesophase obtained by this simplified process is not of as high quality as that resulting from fluxing and filtration, it is suitable for use in many applications and is of higher quality than mesophase obtained from isotropic pitch by other processes such as gas sparging, gravity separation. In this aspect of the invention the heat soaked isotropic pitch containing mesogens is combined with the solvent in a suitable manner. For example, the pitch may be melted and combined with heated solvent and the combination then subjected to supercritical conditions. Alternatively the pitch may be subjected to supercritical conditions of the particular solvent used and then combined with solvent, also provided under supercritical conditions. After they are combined the pitch and solvent are subjected to mixing or agitation to provide an intimate admixture of the materials prior to effecting phase separation. Thereafter the procedure followed is the same as that previously described for the preferred embodiment of the invention subsequent to the filtration step. The solvents employed in this aspect of the invention are the same as those previously listed for the preferred embodiment. The amount of solvent used is up to about 12 parts per part by weight of pitch and preferably from about 0.5 to about 8.0 parts of solvent per part of pitch.

The process of the invention may be further exemplified by reference to the flow scheme shown in the drawing. Referring to the drawing, filtered flux liquid, which is a mixture of isotropic pitch, solvent, and solubilized mesogens, is introduced through line 2 to mixer 5 and is joined by solvent provided via line 28. Both of these streams are increased in pressure and temperature to supercritical conditions prior to their introduction to the mixer. After thorough mixing the materials are introduced to phase separator 4, wherein phase separation takes place to provide a mixture of isotropic pitch and solvent in the upper portion of the separator and mesophase containing dissolved solvent in the lower portion of the separator. The bottom phase in the separator is removed through line 6 and introduced to stripper 8 where separation and recovery of the solvent is effected. For this purpose, stripping gas is introduced to the stripper through line 10. Mesophase pitch product is withdrawn from the bottom of the stripper through line 12 and stripping gas and solvent are removed overhead through line 14 and passed to flash drum 16. The solvent and stripping gas in the flash drum are joined by isotropic pitch and solvent removed overhead from phase separator 4 through line 18. In the flash drum conditions of temperature and pressure are maintained to provide separation of solvent and stripping gas from the isotropic pitch, which is withdrawn from the bottom of the flash drum through line 20. The solvent and stripping gas are taken overhead through line 22 and introduced to separator 24 where the solvent and stripping gas are separated. The gas is withdrawn overhead through line 30 and solvent is removed from the bottom of the separator and is recycled to the fluxing operation through line 26. A part of the solvent is also transferred through line 28 for combination with the filtered flux entering mixer 5 as previously described.

The drawing has been described by reference to the preferred embodiment of the invention; however, the same process procedure is followed when fluxing and filtration are not employed. In this case the feed to mixer 5 through line 1 is isotropic pitch containing mesogens rather than filtered flux.

The following examples illustrate the results obtained in carrying out the invention.

EXAMPLE 1

An isotropic feedstock was prepared by heat soaking an 850+° F. cut of decant oil from an FCC unit for six hours at 741° F. The heat soaked pitch was then fluxed by conventional means by combining the pitch and flux solvent (toluene) in about equal amounts at the reflux temperature of toluene. Flux filtration of the mixture removed particles down to submicron size. The filtered flux liquid was then vacuum distilled to remove the toluene. A clean, solid heat soaked pitch with a hot stage melting point of 123° C. resulted from this procedure. 285 gm of this pitch were mixed with an initial 950 gm of toluene in a 2-liter high pressure stirred autoclave. The system was heated to a processing temperature of 340° C. under autogenous pressure. Upon reaching the operating temperature, 834 gm of additional toluene were added to raise the operating pressure to 1215 psia. The resulting mixture of about 22.8 percent pitch in toluene was then agitated at 500 rpm for a period of one hour. Processing conditions during agitation were 340° C. and 1215 psia pressure. After one hour, the agitator was turned off and the mixture was permitted to equilibrate and settle for 30 minutes. Following the settling period, samples were obtained at operating pressure from the top and bottom of the autoclave using heated sample containers. These samples were the basis of all subsequent analyses.

The top equilibrated phase was 81.9 weight percent toluene, with the remainder being extracted pitch oils. The bottom phase was 24.9 weight percent toluene, with the remainder being non-volatile mesophase pitch. Product yield in the bottom phase as a percentage of feed weight was 27 percent on a toluene-free basis. The non-volatile material from the bottom phase was removed from the sample container and heated to 360° C. and held for 30 minutes under vacuum to remove the volatiles.

The mesophase content of the product from the bottom phase by hot stage examination was determined from a polished section, using optical image analysis. The product was 100 percent mesophase. The hot stage melting point of the material was 337° C. The material was successfully press spun into a continuous fiber at a spinning temperature of 360° C. The fiber was stabilized and carbonized by conventional means. Properties from samples of the fiber were as follows:

| | |
|---|---|
| Tensile Strength (Kpsi) | 320 |
| Modulus (Mpsi) | 33 |
| Elongation (%) | 0.81 |

These properties are indicative of a fiber of acceptable quality.

EXAMPLE 2

A 1000 gm sample of the heat-soaked aromatic pitch prepared in Example 1 was fluxed 1:1 in toluene at 110° C. Flux filtering netted 4.6% insolubles. The flux filtrate was diluted with comix solvent (toluene/heptane) at a ratio of 8 ml per gram of pitch feed. This rejection mixture was cooled to 30° C. and the precipitate was isolated by filtration, washed and dried. The yield, melting temperature and mesophase content of the precipitate and the toluene:heptane comix ratio are shown below:

| | |
|---|---|
| Comix-toluene:heptane (ml:ml) | 88:12 |
| Precipitate Properties | |
| Yield, wt % | 20.1 |
| Melting temp., °C. | 322 |
| Mesophase content, % | 100 |

The properties of the mesophase pitch obtained in this example using the prior art solvent fractionation process are comparable to the 27 wt% yield, 337° C. melting temperature and 100 percent mesophase content obtained in Example 1 using the process of the invention.

The comix toluene:heptane ratio may be used to control the melting point of the precipitate. Increasing the amount of heptane during rejection will precipitate a softer (lower melting) product and result in a slightly higher yield.

EXAMPLE 3

Two tests were carried out with the feedstock of Example 1. Heat soaking, flux filtration and recovery of mesophase were carried out in the same manner and under the same conditions as in Example 1, except that the operating pressure and solvent-to-pitch ratio were varied as shown in the following table.

TABLE 1

| | PROCESS CONDITIONS | | | |
|---|---|---|---|---|
| Test | Temp. °C. | Pressure psia | Percent Heat Soaked Pitch* | Mesophase Hot Stage Melt Temp. °C. |
| Control (Ex. 1) | 340 | 1215 | 22.8 | 337 |
| 1 | 340 | 2710 | 24.6 | 428 |
| 2 | 340 | 1420 | 43.7 | 310 |

*Percent heat soaked pitch in mixture of solvent and pitch subjected to supercritical conditions of temperature and pressure.

Test 1 illustrates the effect of pressure on solubility and thus the pitch melting point. Increasing the pressure increases the solubility of the pitch in the solvent which provides a separated mesophase product having a higher melting point.

Test 2 illustrates the effect of solvent-to-pitch ratio on solubility and the mesophase melting point. Reducing the amount of solvent decreases the solubility of the pitch in the solvent which results in a separated mesophase product of lower melting point.

While certain embodiments and details have been shown for the purpose of illustrating the present invention, it will be apparent to those skilled in the art that various changes and modifications may be made herein without departing from the spirit or scope of the invention.

In the process of the invention all of the above variables interact and are controlled to provide the desired mesophase product and ultimately the properties of the fiber made from such product.

Obviously, many modifications and variations of the invention, as hereinbefore set forth, may be made without departing from the spirit and scope thereof, and therefore only such limitations should be imposed as are indicated in the appended claims.

We claim:

1. A process for the preparation of mesophase pitch which comprises:

(a) combining an isotropic pitch containing mesogens with a solvent, (b) effecting phase separation of the mesogens from the isotropic pitch under solvent supercritical conditions of temperature and pressure, wherein said mesogens associate together under solvent supercritical conditions of temperature and pressure to form mesophase pitch; and (c) recovering mesophase pitch.

2. The process of claim 1 in which the isotropic pitch is obtained by heat soaking a pitch.

3. The process of claim 2 in which the isotropic pitch is obtained by heat soaking a petroleum pitch.

4. The process of claim 3 in which the solvent used to solubilize the mesogens is selected from the group consisting of aromatics, naptheno-aromatics, alkyl-aromatics, hetero-aromatics, halo derivatives of paraffins containing 1–4 carbon atoms and halogenated aromatics and mixtures thereof, all whose critical temperatures are below about 500° C.

5. The process of claim 4 in which the solvent used to solubilize the mesogens is toluene.

6. The process of claim 4 in which the solvent used to solubilize the mesogens is xylene.

7. A process for the preparation of mesophase pitch which comprises:

(a) subjecting an isotropic pitch containing mesogens to fluxing with a solvent to solubilize the mesogens, (b) filtering the flux mixture to remove insolubles, (c) separating the solubilized mesogens from the flux solvent under solvent supercritical conditions of temperature and pressure, wherein said mesogens associate together under solvent supercritical conditions of temperature and pressure to form mesophase pitch; and (d) recovering mesophase pitch.

8. The process of claim 7 in which the isotropic pitch is obtained by heat soaking a pitch.

9. The process of claim 8 in which the isotropic pitch is obtained by heat soaking a petroleum pitch.

10. The process of claim 9 in which the solvent used to solubilize the mesogens is selected from the group consisting of aromatics, naptheno-aromatics, alkyl-aromatics, hetero-aromatics, halo derivatives of paraffins containing 1–4 carbon atoms and halogenated aromatics all whose critical temperatures are below about 500° C.

11. The process of claim 10 in which additional flux solvent is added to the system in step (c).

12. The process of claim 11 in which the solvent used to solubilize the mesogens is toluene.

13. The process of claim 11 in which the solvent used to solubilize the mesogens is xylene.

14. A process for producing mesophase pitch which comprises:

(a) subjecting a pitch to heat soaking to form an isotropic pitch containing mesogens but substantially free of mesophase, (b) fluxing the isotropic pitch with a solvent to form a mixture and to solubilize the mesogens, (c) filtering the flux mixture in step (b) to remove insolubles and any mesophase, (d) phase separating the solubilized mesogens from the solvent in step (b) under solvent supercritical conditions of temperature and pressure, wherein said mesogens associate together under solvent supercritical conditions of temperature and pressure to form mesophase pitch; and (e) recovering mesophase pitch.

15. The process of claim 14 in which the pitch subjected to heat soaking is a petroleum pitch.

16. The process of claim 15 in which the heat soaking is carried out at between about 370° C. and about 500° C. for a time period of between about 0.10 and about 240 hours.

17. The process of claim 16 in which the solvent used to solubilze the mesogens is selected from the group consisting of aromatics, naptheno-aromatics, alkyl-aromatics, hetero-aromatics, halo derivatives of paraffins containing 1–4 carbon atoms and halogenated aromatics all whose critical temperatures are below about 500° C.

18. The process of claim 17 in which additional flux solvent is added to the system in step (d).

19. The process of claim 18 in which the solvent used to solubilize the mesogens is toluene.

20. The process of claim 18 in which the solvent used to solubilize the mesogens is xylene.

21. The process of claim 14 in which the fluxing is carried out at a temperature between about 30° and about 150° C. for between about 0.1 and about 2.0 hours.

22. The process of claim 19 in which the process conditions of temperature and pressure are equal to or above 319° C. and are equal to or above 611 psia.

23. The process according to claim 1 wherein the mesophase pitch is formed into carbon fibers by melt spinning followed by stabilization and carbonization of the fibers.

* * * * *